US009126798B2

(12) United States Patent
Yamamoto et al.

(10) Patent No.: US 9,126,798 B2
(45) **Date of Patent: *Sep. 8, 2015**

(54) KNIFE FOLDING MACHINE

(75) Inventors: Hiroki Yamamoto, Shiga (JP); Shinya Watanabe, Shiga (JP); Tsuyoshi Matsumoto, Shiga (JP); Takehito Yokogi, Shiga (JP); Tatsuaki Ida, Shiga (JP); Friedhelm Pfeiffer, Quickborn (DE)

(73) Assignee: HORIZON INTERNATIONAL INC., Shiga (JP)

( * ) Notice: Subject to any disclaimer, the term of this patent is extended or adjusted under 35 U.S.C. 154(b) by 550 days.

This patent is subject to a terminal disclaimer.

(21) Appl. No.: 13/521,321

(22) PCT Filed: Jan. 18, 2010

(86) PCT No.: PCT/JP2010/050501

§ 371 (c)(1),
(2), (4) Date: Jul. 10, 2012

(87) PCT Pub. No.: WO2011/086700

PCT Pub. Date: Jul. 21, 2011

(65) Prior Publication Data

US 2012/0302415 A1 Nov. 29, 2012

(51) Int. Cl.
*B65H 45/18* (2006.01)

(52) U.S. Cl.
CPC ..... *B65H 45/18* (2013.01)

(58) Field of Classification Search
CPC ..... B65H 45/168; B65H 45/18; B65H 45/00; B65H 45/30; B65H 45/161; B65H 2220/01
USPC ..... 493/429, 424, 425, 426, 427, 431, 434, 493/435, 437, 442, 444
See application file for complete search history.

(56) References Cited

U.S. PATENT DOCUMENTS 4,481,007 A * 11/1984 Hornung ..... 493/444
4,506,873 A 3/1985 Faltin (Continued)

FOREIGN PATENT DOCUMENTS

JP 61-174537 8/1986
JP 10-258966 9/1998

(Continued)

OTHER PUBLICATIONS

Machine Translation of JP10-258966; Date Retrieved: Dec. 10, 2014; 7 pages.*

*Primary Examiner* — Thanh Truong
*Assistant Examiner* — Dianne Mitchell
(74) *Attorney, Agent, or Firm* — Kirschstein, et al.

(57) ABSTRACT

A knife folding machine comprises: a support surface (4) for supporting a lower surface of a sheet (S); a knife blade (5); a pair of folding rollers (6*a*, 6*b*) opposed to the knife blade (5) at a fold position with the support surface (4) therebetween. The knife blade (5) is reciprocated between first and second positions by a knife drive unit 7. The first position is away from an upper surface of the support surface, and the second position is adjacent a gap between the folding rollers. The reciprocal movement of the knife blade (5) effects a folding operation every time the sheet (S) is set at the fold position. The sheet (S) is conveyed to the fold position by the conveyer belt (13). The conveyer belt (13) is driven by a first servomotor (11). The control unit (12) controls the rotation of the first servomotor (11) so as to decelerate the sheet (S) before its abutment against the stopper (14) without its rebounding against the stopper (14).

7 Claims, 10 Drawing Sheets

(56) References Cited

U.S. PATENT DOCUMENTS

| | | | | |
|---|---|---|---|---|
| 5,628,718 | A * | 5/1997 | Huober | 493/29 |
| 6,673,002 | B2 * | 1/2004 | Trovinger et al. | 493/405 |
| 2002/0039956 | A1 * | 4/2002 | Kitai et al. | 493/424 |
| 2007/0158903 | A1 | 7/2007 | Cote et al. | |
| 2007/0222134 | A1 * | 9/2007 | Katayama et al. | 270/41 |
| 2007/0232474 | A1 * | 10/2007 | Yamamoto et al. | 493/420 |
| 2008/0001338 | A1 * | 1/2008 | Kotani | 270/37 |
| 2008/0307940 | A1 * | 12/2008 | Chagnon et al. | 83/444 |

FOREIGN PATENT DOCUMENTS

| | | |
|---|---|---|
| JP | 11060055 | 3/1999 |
| JP | 11-180635 | 7/1999 |
| JP | 2000-007215 | 1/2000 |
| JP | 2004-331402 | 11/2004 |
| JP | 2005-145677 | 6/2005 |

* cited by examiner

KNIFE FOLDING MACHINE

TECHNICAL FIELD OF THE INVENTION

The present invention relates to a knife folding machine for folding a sheet with a knife blade.

BACKGROUND OF THE INVENTION

A conventional knife folding machine generally comprises a frame having a support surface to support a lower surface of a sheet, and a feed means attached to the frame to sequentially feed the sheet to a fold position on the support surface. The feed means comprises a drive roller and an idle roller which are parallel spaced from each other, and a conveyer belt extending between the drive roller and the idle roller. A part of the support surface is formed by a feed surface of the conveyer belt. A stopper is attached to the frame to position the sheet at the fold position by a front end of the sheet abutting the stopper.

The knife folding machine comprises a knife blade, a pair of folding rollers opposed to the knife blade at the folding position with the support surface therebetween; and a slider crank mechanism. The knife blade and the folding rollers extend in parallel to a feed path of the sheet. The slider crank mechanism reciprocates the knife blade between first and second positions via an opening through which the knife blade passes. The opening is formed on the support surface. The first position is opposite to the folding rollers with the support surface therebetween and spaced from the support surface. The second position is adjacent a gap between the folding rollers.

The knife blade has one end fixed to a rod which is connected with a crank of the slider crank mechanism. The crank makes one revolution every time the sheet is set at the fold position. During one revolution of the crank, the knife blade reciprocates between the first position (upper dead point) and the second position (lower dead point) so as to effect a folding operation. While the knife blade moves from the first position to the second position, the sheet on the support surface is folded in two by the knife blade, then an edge of the folded portion thereof is pushed out of the opening and inserted into the gap between the folding rollers so that the sheet can be folded by the folding rollers.

The conventional knife folding machine feeds the sheet to the fold position at a constant speed and sets the sheet at the fold position by a front end of the sheet abutting the stopper. It is preferable to feed the sheet at high-speed so as to increase a processing efficiency. However if the feed speed of the sheet becomes high, the sheet cannot be accurately set at the fold position because of the sheet rebounding from the stopper, and the sheet may be damaged or wrinkle by the sheet colliding with the stopper.

In order to solve the problems, in the conventional knife folding machine, a brush is attached opposite to the feed surface of the conveyer belt to contact the upper surface of the feed sheet to decelerate the sheet (see, for example, Patent Document 1), or a deceleration belt is arranged opposite to the conveyer belt to contact the upper surface of the sheet conveyed by the conveyer belt to decelerate the sheet (see, for example, Patent Document 2). The deceleration means disposed on the feed path of the sheet contacts the sheet to keep the speed of the sheet at a constant high-speed during feeding the sheet but reduce the speed of the sheet before the sheet abutting the stopper.

However these deceleration means decelerate the sheet conveyed by the conveyer belt by applying dynamic friction to the sheet and slipping the sheet on the feed surface of the conveyer belt. The deceleration means cannot always accurately stop the sheet at the fold position since it is difficult to control the position of the sheet on the way of decelerating. As a result, a position of the fold line on the sheet may be misaligned, which leads to the reduction of accuracy of the folding and a poor finish in the subsequent processes such as a sewing process and so on.

Patent Document 1: JP 2004-331402 A

Patent Document 2: JP 11-180635 A

SUMMARY OF THE INVENTION

Problems to be Solved by the Invention

It is an object of the present invention to provide a knife folding machine which can achieve an accurate folding operation without damage and wrinkle of the sheet while keeping the processing speed high.

Solution to the Problems

In order to achieve the objects, the present invention provides a knife folding machine, comprising:

a frame having a support surface to support a lower surface of a sheet;

a feed means attached to the frame to sequentially feed the sheet to a fold position on the support surface;

a stopper attached to the frame and extending in a direction perpendicular to a feed path of the sheet, the stopper positioning the sheet at the fold position by a front end of the sheet abutting the stopper;

a knife blade;

a pair of folding rollers opposed to the knife blade at the fold position with the support surface therebetween, the folding rollers being attached to the frame, the knife blade and the folding rollers being disposed in parallel to each other and the feed path, the support surface having an opening through which the knife blade passes;

a knife drive unit for reciprocating the knife blade in a direction perpendicular to the support surface through the opening between a first position and a second position, the first position being opposite to the folding rollers with the support surface therebetween and spaced from the support surface, the second position being adjacent a gap between the folding rollers;

a support arm attached to the frame to support the knife drive unit; and a control unit for controlling the knife drive unit; wherein the reciprocal movement of the knife blade between the first and second positions effects a folding operation every time the sheet is set at the fold position, wherein while the knife blade moves from the first position to the second position, the sheet on the support surface being folded in two by the knife blade, an edge of the folded portion thereof being pushed out of the opening and inserted into the gap between the folding rollers so that the sheet can be folded by the folding rollers; wherein the feed means comprises:

- a drive roller and an idle roller attached to the frame and parallel spaced from each other;
- at least one conveyer belt extending between the drive roller and the idle roller and circulating along the feed path; and
- a first servomotor attached to the frame to rotate the drive roller, a part of the support surface being formed by a feed surface of the conveyer belt, the first servomotor being controlled by the control unit; wherein the knife folding machine further comprises:

a sensor disposed in the middle way of the feed path to detect a passage of the sheet; wherein the control unit decelerates the first servomotor to a predetermined rotary speed during the period from the passage of the sheet through the sensor to its abutment against the stopper so as to prevent the sheet from rebounding from the stopper when the sheet abutting against the stopper; and wherein the control unit accelerates the first servomotor to a rotary speed before the deceleration during the period from the start of the folding operation to the start of the feed of the next sheet.

Note that, the term of the "sheet" includes not only a sheet material but also a sheet bundle.

According to a preferred embodiment of the present invention, the control unit decelerates or accelerates the first servomotor at a predetermined constant acceleration.

According to further preferred embodiment of the present invention, the control unit comprises:

a first input portion for receiving input of a coordinate correction amount to correct a default start position of deceleration between the stopper and the sensor in a direction of the feed path; and a first memory for storing the coordinate correction amount inputted through the first input portion; and wherein the control unit starts the deceleration of the servomotor when the control unit detects an arrival of the front end of the sheet at the start position of deceleration which was shifted depending on the coordinate correction amount based on an output value from an encoder installed in the first servomotor.

According to further preferred embodiment of the present invention, the control unit comprises:

a first input portion for receiving input of a coordinate correction amount to correct a default start position of deceleration between the stopper and the sensor in a direction of the feed path;

a first memory for storing the coordinate correction amount inputted through the first input portion; and a timer for measuring a time elapsed from the passage of the front end of the sheet through the sensor; and wherein the control unit starts the deceleration of the servomotor when the control unit detects an arrival of the front end of the sheet at the start position of deceleration which was shifted depending on the coordinate correction amount based on a measurement value of the timer.

According to further preferred embodiment of the present invention, the knife drive unit comprises:

a holder attached to the support arm;

a rod extending in a direction perpendicular to the support surface and attached to the holder to reciprocate in an axial direction thereof, the rod being attached to the knife blade at one end thereof;

a block attached to a center portion of the rod;

a feed screw extending in parallel to the rod and attached to the holder to rotate around an axis thereof, the block having a thorough hole which has thread grooves corresponding to the feed screw, the feed screw engaging with the through hole, the rod being reciprocated by the rotation of the feed screw;

a first pulley attached to an upper or lower end of the feed screw;

a second servomotor attached to the holder and having a drive shaft, the drive shaft extending in parallel to the feed screw;

a second pulley attached to the drive shaft of the second servomotor; and a timing belt extending between the first and second pulleys, the second servomotor being controlled by the control unit.

According to further preferred embodiment of the present invention, the control unit comprises:

a second input portion for receiving input of both data of a distance from the support surface to the first position and data of a distance from the support surface to the second position; and a second memory for storing the data of the distances inputted through the second input portion; and wherein the control unit controls the second servomotor based on the data of the distances stored in the second memory.

According to further preferred embodiment of the present invention, the control unit comprises:

a third input portion for receiving input of a time correction value to correct a default time from the passage of the front end of the sheet through the sensor to the start of the folding operation of the knife blade; and a third memory for storing the time correction value inputted through the third input portion; and wherein the folding operation is started when a time summed up in both the default time and the time correction value is elapsed after the passage of the front end of the sheet through the sensor.

Effect of the Invention

According to the present invention, the conveyer belt is driven by the servomotor whose rotation is controlled so that the sheet is decelerated at a constant acceleration before its abutment against the stopper without its rebounding from the stopper. And thereby it is possible to decelerate the sheet without the deceleration means contacting the upper surface of the sheet conveyed by the conveyer belt while keeping the processing speed high. Consequently the position of the sheet can be easily controlled while the sheet decelerated, and the sheet can accurately stop at a preset fold position at all times. And a high accuracy of the sheet folding is achieved.

According to the present invention, it is possible to prevent the sheet from rebounding against the stopper and accurately stop the sheet at the preset fold position by correcting a default start position of the deceleration of the sheet and shifting the start position of the deceleration in a direction toward and away from the stopper in the case that the sheet conveyed by the conveyer belt slips on the feed surface of the conveyer belt.

DETAILED EXPLANATION OF THE PREFERRED EMBODIMENTS

Figure 1:
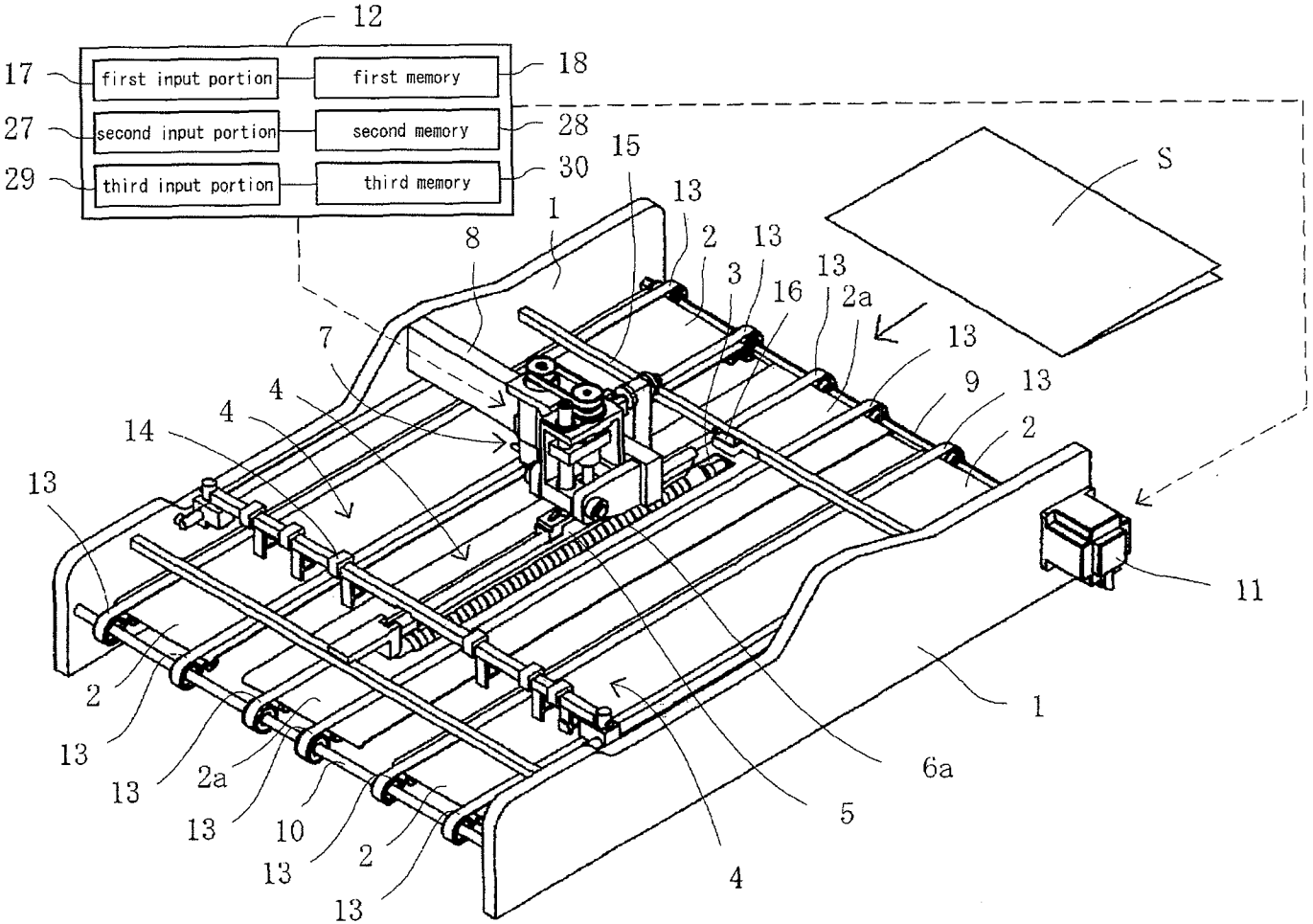
FIG. 1 is a perspective view showing a knife folding machine according to one embodiment of the present invention, in which no sheet is set at a fold position of the knife folding machine.
Figure 2:
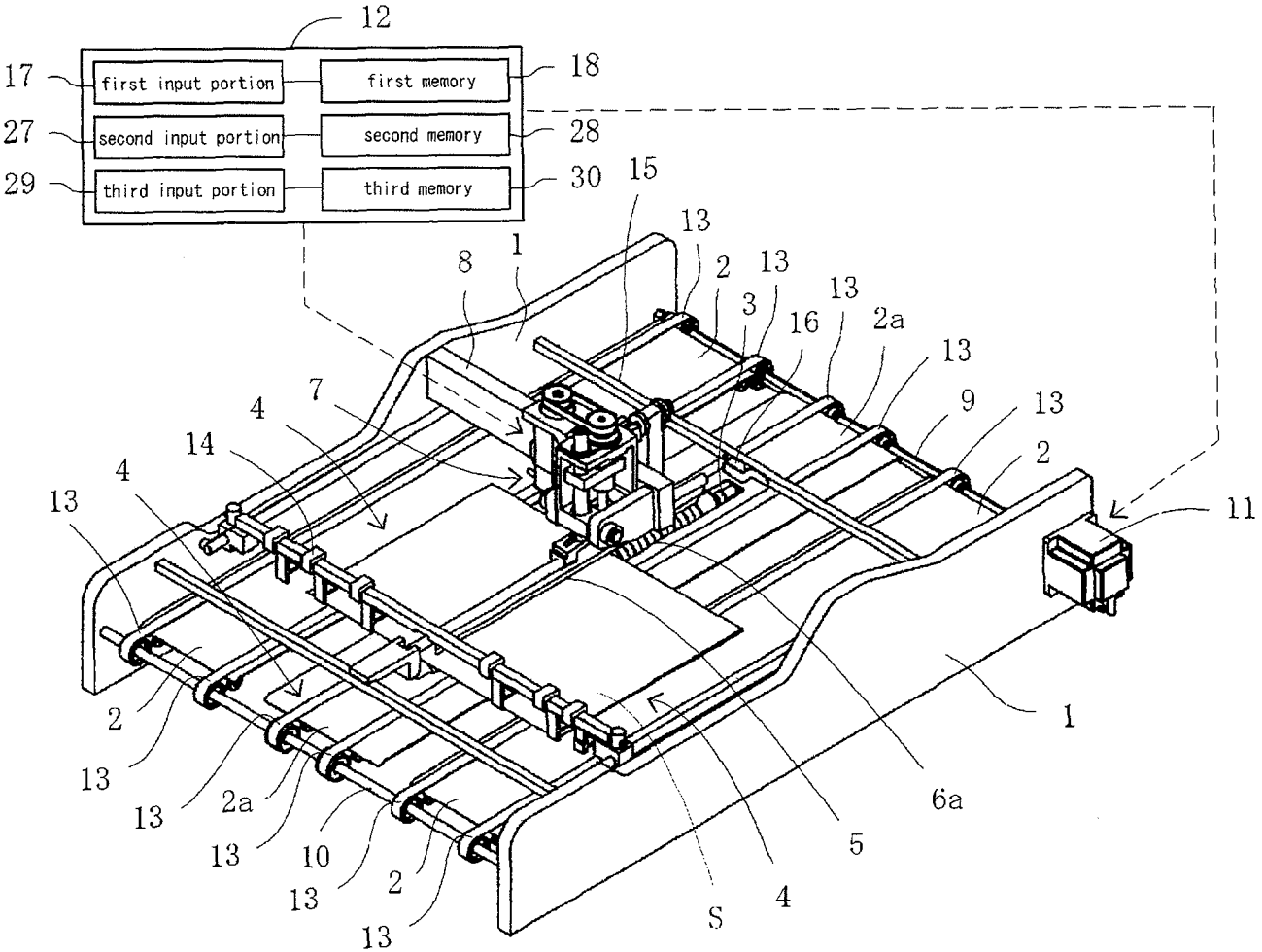
FIG. 2 is a perspective view showing the knife folding machine according to one embodiment of the present invention, in which the sheet is set at a fold position of the knife folding machine.

A preferred embodiment of the present invention will be explained below with reference to the accompanying drawings. FIG. 1 is a perspective view showing a knife folding machine according to the first embodiment of the present invention, in which no sheet is not set at a fold position of the knife folding machine. FIG. 2 is a perspective view showing the knife folding machine according to the first embodiment of the present invention, in which a sheet is set at the fold position of the knife folding machine. As shown in FIGS. 1 and 2, the knife folding machine of the present invention comprises a frame 1. A plurality of elongated plates 2, 2*a* are attached to the upper surface of the frame 1 and spaced from each other widthwise. The upper surfaces of these plates 2, 2*a* construct a part of a support surface 4 for supporting a lower surface of a sheet S (including not only a sheet but also a sheet bundle, same below).

A pair of folding rollers 6*a*, 6*b* are opposed to a knife blade 5 with the support surface 4 therebetween at the fold position on the support surface 4. In this embodiment, the knife blade 5 is disposed above the center plate 2*a* (the support surface 4) and the folding rollers 6*a*, 6*b* are disposed below the center plate 2*a*. In another embodiment, the knife blade 5 may be disposed below the center plate 2*a* and the folding rollers 6*a*, 6*b* may be disposed above the center plate 2*a*.

The folding rollers 6*a*, 6*b* are attached to the frame 1. The knife blade 5 and the folding rollers 6*a*, 6*b* are disposed in parallel to each other and the center plate 2*a*. An opening 3 through which the knife blade 5 passes is formed on the center plate 2*a* and extends longitudinally thereof. One end of the knife blade 5 is opposed to a gap between the folding rollers 6*a*, 6*b*.

The knife folding machine comprises a knife drive unit 7. The knife drive unit 7 reciprocates the knife blade 5 between first and second positions through the opening 3 in a direction perpendicular to the support surface 4. The first position is arranged above the support surface 4 with spacing. The second position is disposed adjacent the gap between the folding rollers 6*a*, 6*b*. The knife drive unit 7 is supported by a support arm 8 attached to the frame 1.

The knife folding machine further comprises a feed means attached to the frame 1 to sequentially feed the sheet S to the fold position in a direction parallel to the knife blade 5 on the support surface 4.

The feed means comprises a drive roller 9 and an idle roller 10 which are attached to the frame 1 and respectively disposed on opposite ends of the frame 1 below the support surface 4 (plates 2, 2*a*). Each of rotation shafts of the drive roller 9 and the idle roller 10 is disposed in parallel to each other and extends in a direction perpendicular to the knife blade 5. The drive roller 9 is driven by a first servomotor 11 fixed to the frame 1. The first servomotor 11 is controlled by the control unit 12.

A plurality of conveyer belts 13 extends between the drive roller 9 and the idle roller 10. The conveyer belts 13 circulate and a feed surface thereof forms a feed path of the sheet S. Two conveyer belts 13 are arranged for each of the plates 2, 2*a* and spaced from each other. Each of upper portions of the conveyer belts 13 is disposed above the plates 2, 2*a* so that the feed surface of the conveyer belts 13 forms a part of the support surface 4.

The knife folding machine further comprises a stopper 14 attached to the frame 1 to position the sheet S at the fold position on the support surface 4. The stopper 14 is disposed at a downstream of the knife blade 5 and extends in a direction perpendicular to the feed path of the sheet S on the support surface 4. The stopper 14 positions the sheet S at the fold position by its abutment of the front end of the sheet S against the stopper 14.

A horizontal support bar 15 is attached to the frame 1 at its opposed ends and extends in a direction perpendicular to the feed path of the sheet S at an upstream of the opening 3 of the plate 2*a*. A sensor 16 is attached to the center of the support bar 15 to detect a passage of the sheet S.

The stopper 14 is movable along the feed path of the sheet S in a direction toward and away from the sensor 16.

The control unit 12 decelerates the first servomotor 11 to a predetermined rotary speed during the period from the passage of the sheet S through the sensor 16 to its abutment against the stopper 14. The rotary speed is set in such a way that the sheet S cannot rebound from the stopper 14 when the sheet S abuts the stopper 14. And then the control unit 12 accelerates the first servomotor 11 to a rotary speed before the deceleration during the period from the start of the folding operation to the start of the feed of the next sheet S. Thus the feed speed of the sheet S reduces during the period from the passage of the sheet S through the sensor 16 to its abutment against the stopper 14 so that the sheet S accurately stops at the fold position without rebounding against the stopper 14, and after finishing the folding operation of the sheet S the next sheet S is conveyed to the fold position at a feed speed before reducing.

It is possible to decelerate and accelerate the first servomotor 11 at a constant acceleration, or it is possible to decelerate and accelerate the first servomotor 11 with changing the acceleration. In the embodiment, the first servomotor 11 decelerates and accelerates at a predetermined constant acceleration $\alpha$.

The first servomotor 11 may start to decelerate at any point in a path from point where the sheet S passes through the sensor 16 to point where the sheet S abuts the stopper 14. The first servomotor 11 may start to accelerate at any time in time from when the folding operation of the sheet S starts till when the next sheet S starts to be conveyed.

In this embodiment the initial setting of the first servomotor 11 is conducted in such a way that the first servomotor 11 starts to decelerate when the front end of the sheet S arrives at the start position of the deceleration after the passage of the sheet S through the sensor 16, the start position of the deceleration being preset between the sensor 16 and the stopper 14.

The control unit 12 comprises a first input portion 17 for receiving input of a coordinate correction amount to correct the start position of the deceleration in a direction of the feed path, and a first memory 18 for storing the coordinate correction amount inputted through the first input portion 17.

Figure 6:
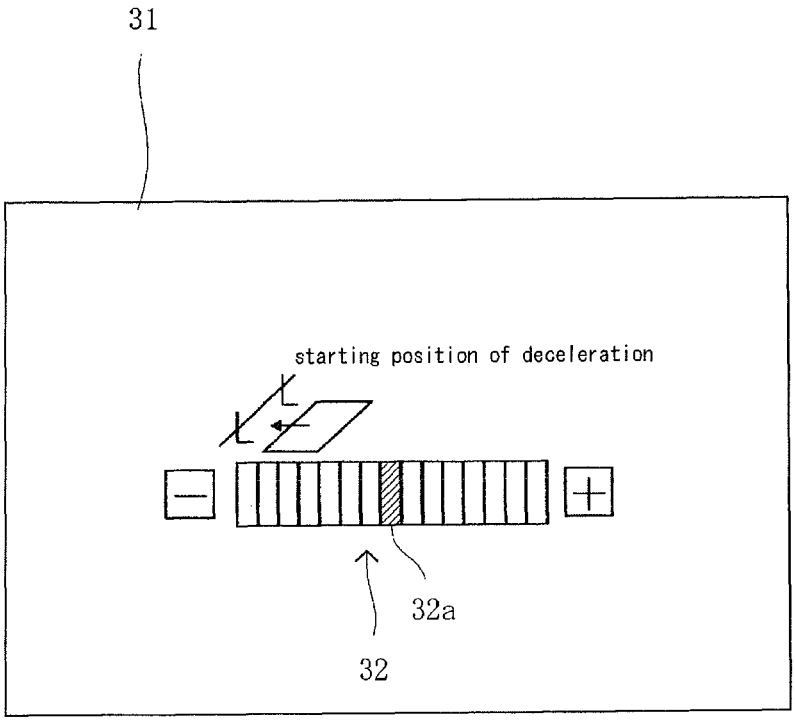
FIG. 6 is a plan view showing a touch screen as a first input portion of the knife folding machine of FIG. 1.

In this embodiment, as shown in FIG. 6, the first input portion 17 is formed by a touch screen 31. In the touch screen 31 there is a bar-like display portion 32 for indicating a set value of the coordinate correction amount in a step-by-step manner. At the left side of the display portion 32 there is "–" button, meanwhile, at the right side thereof there is "+" button. A center block 32*a* of the display portion 32 is constantly shown in red color and indicates the position of zero of the coordinate correction amount. The start position of the deceleration is shifted toward the sensor 16 along the feed path of the sheet S by 0.1 mm at one touch of the "–" button. Meanwhile, the start position of the deceleration is shifted toward the stopper 14 along the feed path of the sheet S by 0.1 mm at one touch of the "+" button. With the touch of the "–" and "+" buttons some blocks disposed at the left and right sides of the center block 32*a* of the display portion 32 are indicated by blue or cleared. Thus the resulting blue bar is shown in the display portion 32 and extends toward the left or right side of the center block 32*a* when the coordinate correction amount is set. When the blue bar extends toward the left side of the center block 32*a*, the start position of the deceleration is shifted away from the stopper 14. When the blue bar extends toward the right side of the center block 32*a*, the start position of the deceleration is shifted toward the stopper 14.

The reason why the coordinate correction amount can be inputted to correct the start position of the deceleration will be explained below. The start position of the deceleration is preset in the assumption that the sheet S conveyed by the conveyer belt 13 does not slip on the feed surface of the conveyer belt 13. However there are generally two types of the sheet S, that is, one of which slips and the other of which does not slip while the sheet S conveyed despite the same feed speed, because of the weight of the sheet and the friction coefficient between the sheet S and the conveyer belt 13 and so on. In the case that the sheet S is apt to slip while the sheet S conveyed, it is possible to prevent the sheet S from rebounding against the stopper 14 by shifting the default start position of the deceleration in a direction toward and away from the stopper 14 along the feed path.

Therefore the correction of the start position is conducted if necessary, and generally the coordinate correction amount is preset to zero.

Figure 3:
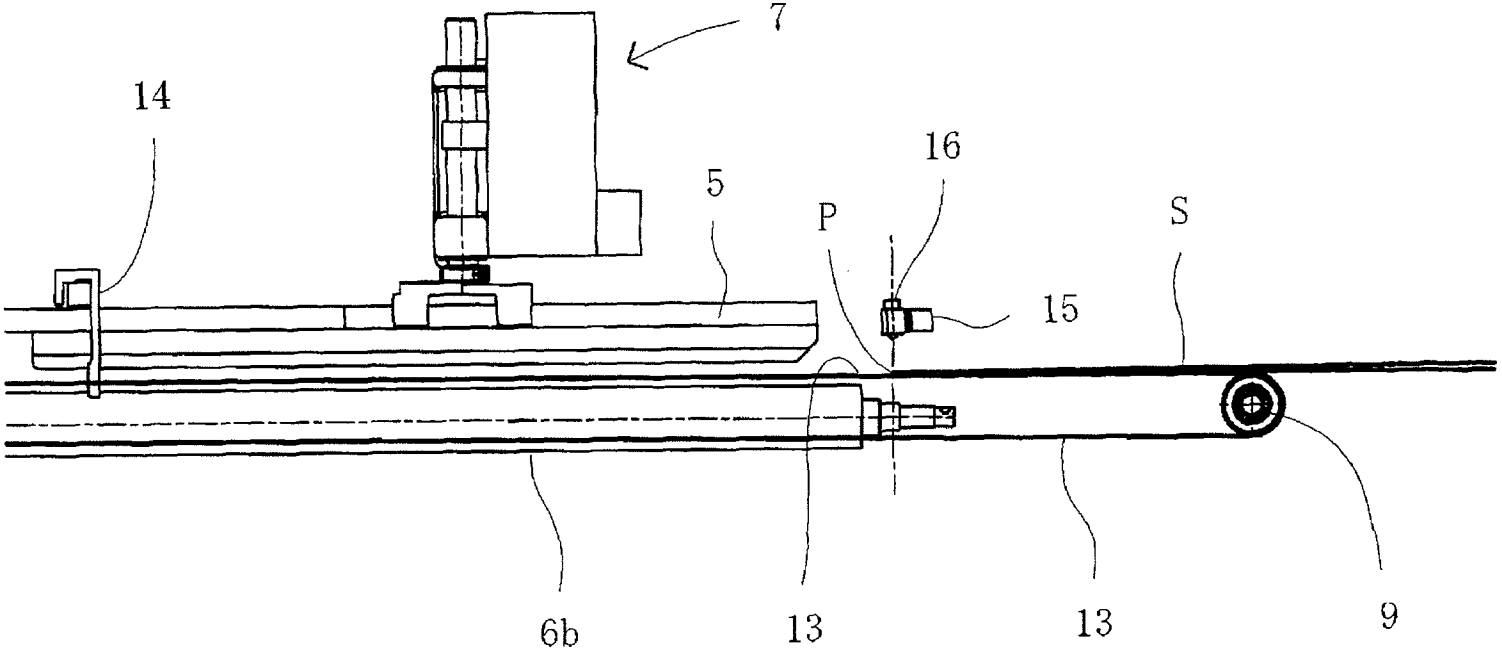
FIG. 3 is a side elevation view illustrating a decelerating operation of a feed speed of the sheet of the knife folding machine of FIG. 1, in which a front end of the sheet reaches a position of a sensor.
Figure 4:
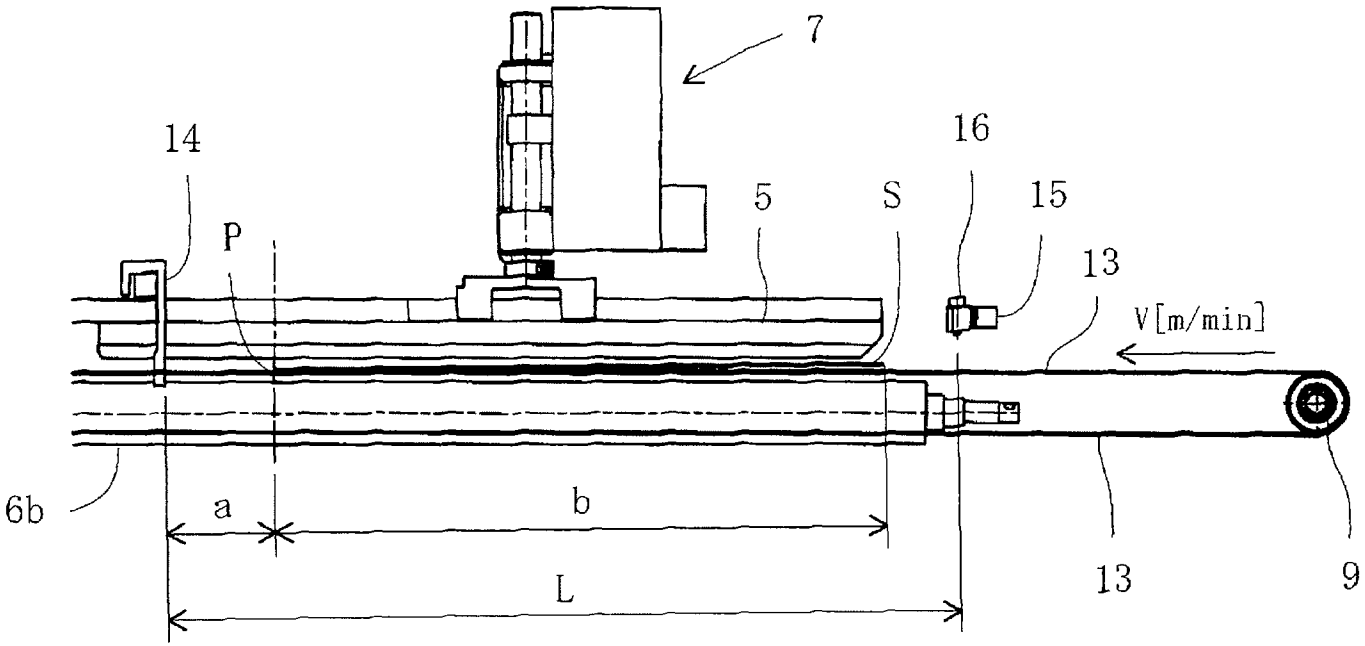
FIG. 4 is a side elevation view illustrating a decelerating operation of the feed speed of the sheet of the knife folding machine of FIG. 1, in which the front end of the sheet arrives at the start position of deceleration.
Figure 5:
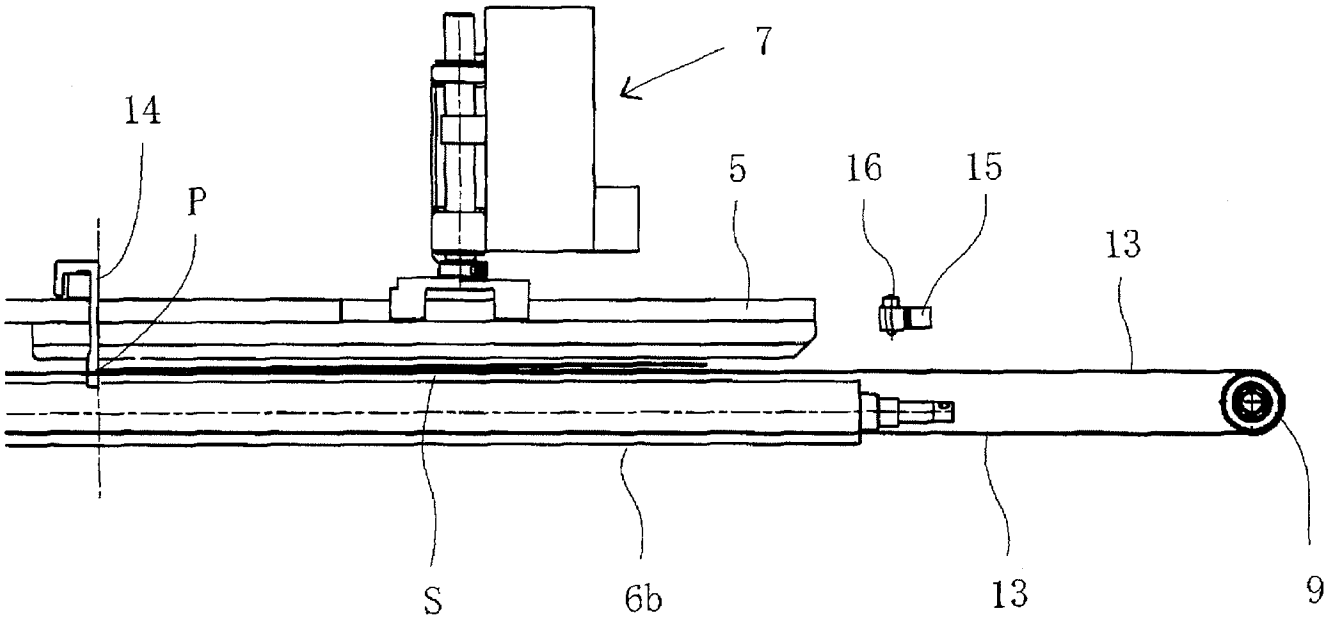
FIG. 5 is a side elevation view illustrating a decelerating operation of the feed speed of the sheet of the knife folding machine of FIG. 1, in which the front end of the sheet abuts a stopper.
Figure 7:
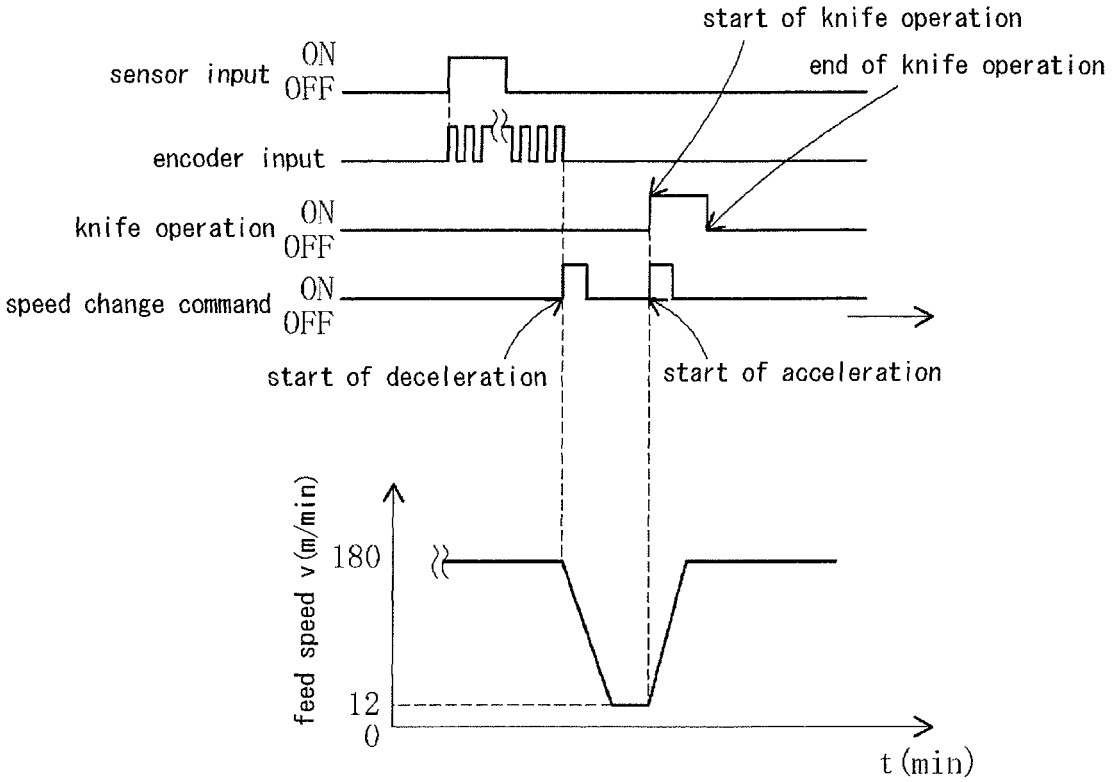
FIG. 7 is a timing chart showing a decelerating operation and a folding operation of the sheet of the knife folding machine of FIG. 1.

FIG. 3 is a side elevation view illustrating a decelerating operation of a feed speed of the sheet of the knife folding machine of FIG. 1, in which a front end of the sheet reaches a position of a sensor. FIG. 4 is a side elevation view illustrating a decelerating operation of the feed speed of the sheet of the knife folding machine of FIG. 1, in which the front end of the sheet arrives at the start position of deceleration. FIG. 5 is a side elevation view illustrating a decelerating operation of the feed speed of the sheet of the knife folding machine of FIG. 1, in which the front end of the sheet abuts a stopper. FIG. 7 is a timing chart showing the decelerating operation and the folding operation of the sheet of the knife folding machine of FIG. 1.

As shown in FIGS. 3-5 and 7, when the front end P of the sheet S passes through the sensor 16 (see also FIG. 3), the control unit 12 receives a detection signal from the sensor 16 and at the same time monitors a pulse output from an encoder (not shown) installed in the first servomotor 11. The control unit 12 sends a speed change command (a deceleration command) to the first servomotor 11, when the control unit 12 detects an arrival of the front end P of the sheet S at the start position of the deceleration based on the output value, the start position being shifted according to the coordinate correction amount (see also FIG. 4). The first servomotor 11 reduces a rotary speed so that the feed speed of the sheet S is reduced from a default speed (for example 180 m/sec) to a predetermined speed (for example 12 m/sec) and the sheet S abuts the stopper 14 at this minimum speed to be positioned at the fold position without rebounding against the stopper 14. At that time the folding operation starts and at the same time the control unit 12 sends a speed change command (an acceleration command) to the first servomotor 11. The first servomotor 11 accelerates to a rotary speed before the deceleration (for example 180 m/sec).

In this embodiment the control unit 12 detects an arrival of the front end P of the sheet S at the start position of the deceleration based on the pulse from the encoder installed in the first servomotor 11, but in another embodiment the control unit 12 comprises a timer for measuring a time elapsed from the passage of the front end P of the sheet S through the sensor 16, and the control unit 12 starts to decelerate the first servomotor 11 when detecting an arrival of the front end P of the sheet S at the start position of the deceleration based on a measurement value of the timer.

According to the present invention, the conveyer belt 13 is driven by the first servomotor 11 whose rotation is controlled so that the sheet S is decelerated at a constant acceleration before its abutment against the stopper 14 without its rebounding against the stopper 14. And thereby it is possible to decelerate the sheet S without the deceleration means contacting the upper surface of the sheet S conveyed by the conveyer belt 13 while keeping the processing speed high. Consequently the position of the sheet S can be easily controlled while the sheet S decelerated, and the sheet S can accurately stop at a preset fold position at all times. And a high accuracy of the sheet folding is achieved.

According to the present invention, it is possible to prevent the sheet from rebounding against the stopper and accurately stop the sheet at the preset fold position by correcting a default start position of the deceleration of the sheet to shift the preset start position of the deceleration in a direction toward and away from the stopper in the case that the sheet conveyed by the conveyer belt slips on the feed surface of the conveyer belt.

Figure 8:
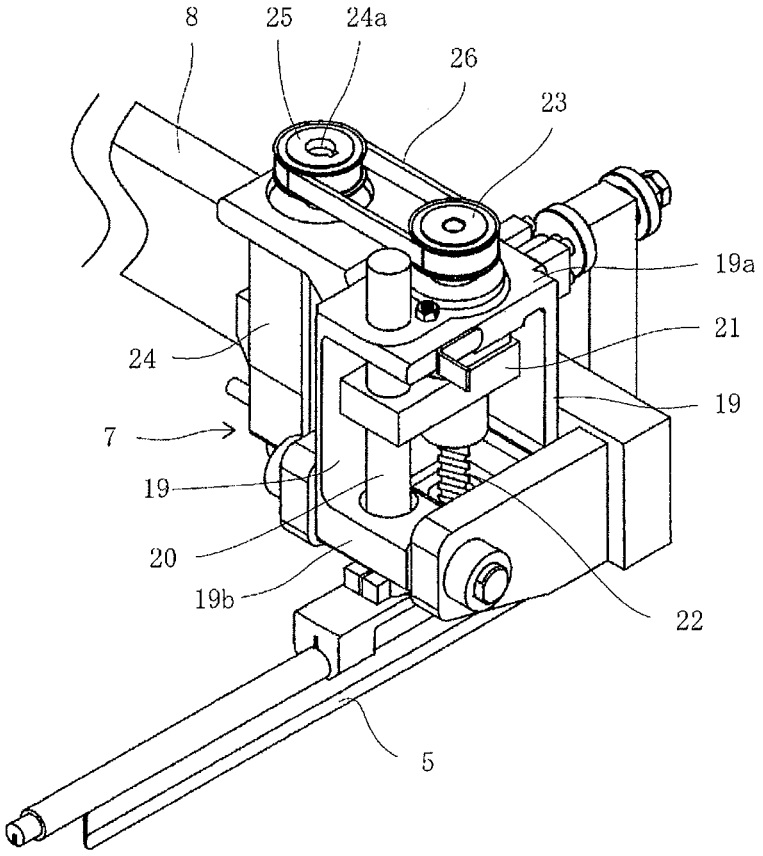
FIG. 8 is a perspective view showing a knife drive unit of the knife folding machine of FIG. 1.

FIG. 8 is a perspective view showing a knife drive unit 7. FIG. 9A is a front view showing the knife drive unit 7 when a knife blade 5 is disposed at the first position. FIG. 9B is a front view showing the knife drive unit 7 when the knife blade 5 is disposed at the second position.

Figure 9:
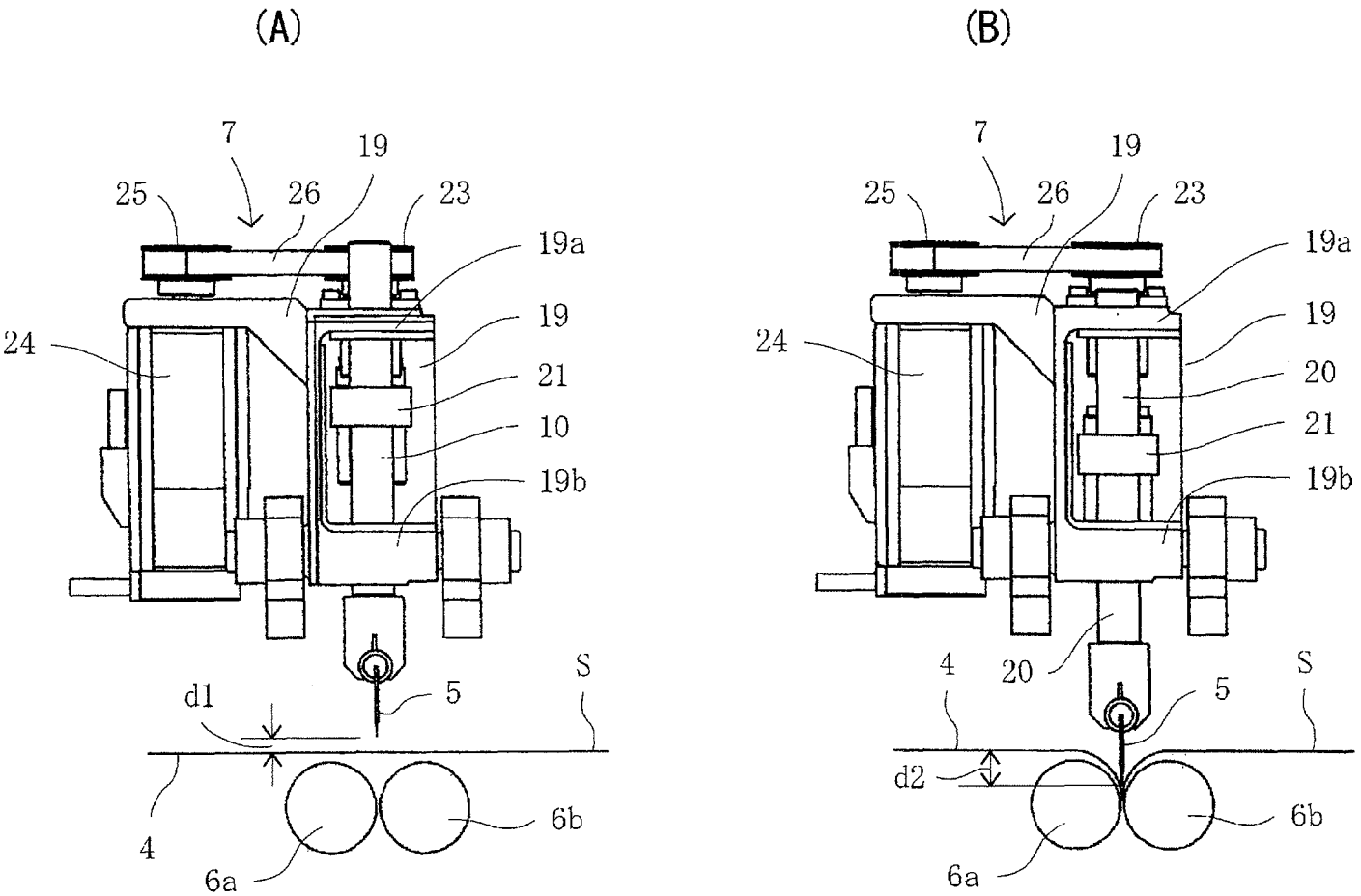
FIG. 9A is a front view showing the knife drive unit of the knife folding machine of FIG. 1 when a knife blade is disposed at a first position.
FIG. 9B is a front view showing the knife drive unit of the knife folding machine of FIG. 1 when the knife blade is disposed at a second position.

As shown in FIGS. 8 and 9, the knife drive unit 7 comprises a holder 19 attached to the support arm 8. The holder 19 has horizontal upper and lower support walls 19*a*, 19*b* which are vertically spaced from each other. A rod 20 extends through the upper and lower support walls 19*a*, 19*b* in a direction vertical or perpendicular to the support surface 4. The rod 20 is attached to the holder 19 via bearings (not shown) disposed in each of the upper and lower support walls 19*a*, 19*b* so as to be reciprocated in an axial direction thereof. The knife blade 5 is fixed on the lower end of the rod 20. A block 21 is fixed on a center portion of the rod 20 (the center portion extends between the upper and lower support walls 19*a*, 19*b*).

A feed screw 22 is attached to rotate around an axis thereof and extends in parallel to the rod 20 between the upper and lower support walls 19*a*, 19*b* of the holder 19. The block 21 has a through hole which provided with thread grooves corresponding to the feed screw 22. The feed screw 22 is engaged with the through hole. While the feed screw 22 rotates, the rod 20 reciprocates in a direction perpendicular to the support surface 4 through the block 11.

The knife drive unit 7 further comprises a first pulley 23 attached to an upper end of the feed screw 22, a second servomotor 24 attached to the holder 19 and having a drive shaft 24*a* in parallel to the feed screw 22, a second pulley 25 attached to the drive shaft 24*a* of the second servomotor 24, and a timing belt 26 extended between the first and second pulleys 23, 25.

In this embodiment, the first pulley 23 is attached to the upper end of the feed screw 22 and driven by the second servomotor 24, but the first pulley 23 may be attached to the lower end of the feed screw 22 and driven by the second servomotor 24.

The second servomotor 24 is controlled by a control unit 12.

The control unit 12 comprises a second input portion 27 for receiving input of both data of a distance d1 (see FIG. 9A) from the support surface 4 to the first position and data of a distance d2 (see FIG. 9B) from the support surface 4 to the second position. The control unit 12 comprises a second memory 28 for storing the data of the distances d1, d2 through the second input portion 27.

Figure 10:
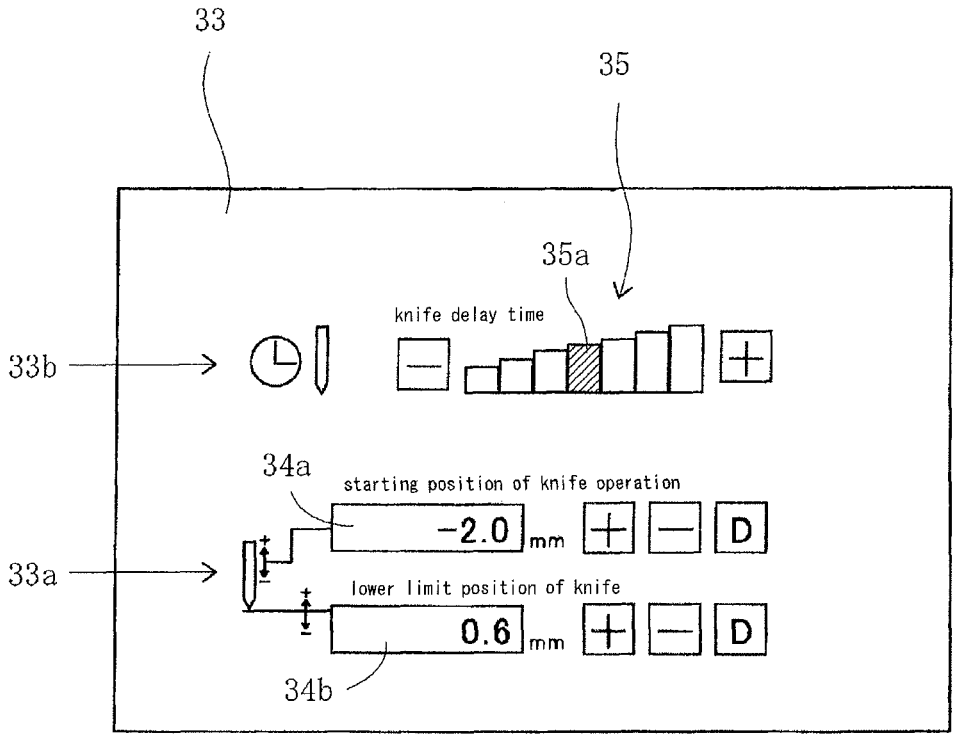
FIG. 10 is a plan view showing a touch screen as second and third input portions of the knife folding machine of FIG. 1.

In this embodiment, as shown in FIG. 10, the second input portion 27 is formed by a lower input area 33*a* of a touch screen 33. In this embodiment, the lower input area 33*a* receives input of values corrected for default values which correspond to distances from the support surface 4 to the first and second positions respectively. Thus the distances d1, d2 are inputted. In the lower input area 33*a* there are upper and lower numerical display columns 34*a*, 34*b*. The upper numerical display column 34*a* indicates the corrected value of the distance d1 in 0.1 mm. The lower numerical display column 34*b* indicates the corrected value of the distance d2 in 0.1 mm.

At the right side of the numerical display columns 34*a*, 34*b*, there are a "+" button for increasing the corrected value, a "−" button for decreasing the corrected value, and a "D" button for setting the corrected value to zero. Each of the corrected values can easily be inputted by touching these buttons.

The control unit 12 calculates an amount of the rotation of the second servomotor 24 corresponding to the distance from the first position to the second position based on the data of the distances d1, d2 stored in the second memory 28 and controls the second servomotor 24.

The second servomotor 24 rotates the feed screw 22 to reciprocate the rod 20 or the knife blade 5 between the first position (see FIG. 9A) and the second position (see FIG. 9B) via the block 21.

The reciprocal movement of the knife blade 5 between the first and second positions effects a folding operation. While the knife blade 5 moves from the first position to the second position, the sheet S on the support surface 4 is folded in two by the knife blade 5, and an edge of the folded portion thereof is pushed out of the opening 3 and inserted into the gap between the folding rollers 6*a*, 6*b* so that the sheet S can be folded by the folding rollers 6*a*, 6*b*.

According to the present invention, the second servomotor 24 rotates the feed screw 22 to reciprocate the rod 20 or the knife blade 5 between the first and second positions. Thus the stroke of reciprocal movement of the knife blade 5 can easily be adjusted so that the first and second positions of the knife blade 5 can separately be adjusted by controlling the amount of rotation of the second servomotor 24.

Further in the present invention, the rod 20 is not subjected to the offset load in a direction away from the axis thereof during the folding operation because the rod 20 and the feed screw 22 are disposed in parallel to each other, so that the durability of the knife folding machine can be improved. Since the rod 20 or the knife blade 5 is reciprocated by the feed screw 22 which is rotated by the second servomotor 24, the overload applied to the knife blade 5 is detected by the second servomotor 24. As a result, when each sheet S is sequentially fed to the fold position every time the folding operation is finished, the paper jam between the folding rollers 6*a*, 6*b* can be avoided by stopping the knife blade 5 in the course of its folding operation even if a plurality of sheets S are accidentally fed at one time.

In this embodiment the knife drive unit comprises the rod arranged to reciprocate in a direction perpendicular to the support surface of the sheet, the feed screw disposed in parallel to the rod, the block operatively connected with the rod and the feed screw, and the servomotor for rotating the feed screw. However the structure of the knife drive unit is not limited to this embodiment, and for example the knife drive mechanism can be composed of a known slider clank mechanism.

The control unit 12 comprises a third input portion 29 for receiving input of a time correction value to correct a default time from the passage of the front end P of the sheet S through the sensor 16 to the start of the folding operation of the knife blade 5, and a third memory 30 for storing the time correction value inputted through the third input portion 29.

The default time is determined as follows. First, as shown in FIG. 4, the stopper 14 is disposed away from the sensor 16 by a distance (L) summed up in both of a distance (b) along the feed path of the sheet S and a predetermined distance. The start position of the deceleration is determined in such a way that it is away from the stopper 14 by a distance (a).

The default time (t), or a time elapsed from the passage of the front end P of the sheet S through the sensor 16 to the arrival of the sheet S at the fold position, can be calculated by the equation as follows:

$$t=(L-a)/v+a/\alpha$$

Wherein, a character (v) designates the feed speed of the sheet S, and the character (α) designates the deceleration while decelerating the sheet S.

In this embodiment, as shown in FIG. 10, the third input portion 29 is formed by an upper input area 33*b* of a touch screen 33. In the upper input area 33*b* there is a bar-like display portion 35 for indicating a set value of the time correction value in a step-by-step manner. At the left side of the display portion 35 there is "−" button, meanwhile, at the right side thereof there is "+" button. A center block 35*a* of the display portion 35 is constantly shown in red color and indicates the position of zero of the time correction value. The time correction value is reduced in 0.1 msec at one touch of the "−" button. Meanwhile, the time correction value is increased in 0.1 msec at one touch of the "+" button. With the touch of the "−" and "+" buttons some blocks disposed at the left and right sides of the center block 35*a* of the display portion 35 are indicated by blue or cleared. Thus the resulting blue bar is shown in the display portion 32 and extends toward the left or right side of the center block 35*a* when the time correction value is set. When the blue bar extends toward the left side of the center block 35*a*, a minus time correction value is inputted. When the blue bar extends toward the right side of the center block 32*a*, a plus time correction value is inputted.

The control unit 12 starts the folding operation when a time summed up in both the default time and the time correction value is elapsed after the front end P of the sheet S passes through the sensor 16.

Thus it is possible to adjust a start time of the folding operation and accurately achieve the folding operation by inputting the time correction value for correcting the default time in the case that the sheet S rebounds against the stopper 14 after its abutment without stopping at the fold position at default time because of the weight of the sheet S and the friction coefficient between the sheet S and the conveyer belt 13 and so on. Therefore the correction of the time is conducted if necessary, and generally the time correction value is preset to zero.

Thus the knife blade 5 moves to the first position based on the set value of the distance (d1) so as to be kept in a standby condition before the start of the operation of the knife folding machine.

Then the first sheet S is conveyed to the folding position by the conveyer belt 13 after the start of the operation of the knife folding machine. When the sensor 16 detects the passage of the front end P of the sheet S, the control unit 12 measures a time elapsed from the passage of the front end P of the sheet S through the sensor 16. And then the sheet S abuts the stopper 14 to stop at the folding position (see also FIG. 2). At that time, the control unit 12 detects the time summed up in both the default time and the time correction value after the passage of the sheet S through the sensor 16, and the folding operation is started by the knife blade 5, so that the knife blade 5 is moved from the first position to the second position.

During the movement, the sheet S on the support surface 4 is folded in two by the knife blade 5, and the edge of the folded portion of the sheet S is pushed out of the opening 3 and inserted into the gap between the folding rollers 6*a*, 6*b* so that the sheet S can be folded by the folding rollers 6*a*, 6*b*. Then the knife blade 5 returns from the second position to the first position. During the reciprocal movement of the knife blade 5 between the first and second positions, the folding operation is effected. The next sheet S is conveyed to the fold position by the conveyer belts 20 every time the folding operation is completed.

DESCRIPTION OF THE REFERENCE CHARACTERS

1 frame
2 plate
2*a* center plate
3 opening
4 support surface
5 knife blade
6*a*, 6*b* folding rollers
7 knife drive unit
8 support arm
9 drive roller
10 idle roller
11 first servomotor
12 control unit
13 conveyer belt
14 stopper
15 support bar
16 sensor
17 first input portion
18 first memory
19 holder
19*a* upper support wall
19*b* lower support wall
20 rod
21 block
22 feed screw
23 first pulley
24 second servomotor
24*a* drive shaft
25 second pulley
26 timing belt
27 second input portion
28 second memory
29 third input portion
30 third memory
31 touch screen
32 set value display portion
32*a* center block
33 touch screen
33*a* lower input area
33*b* upper input area
34*a*, 34*b* numerical display column
35 set value display portion
35*a* center block
P front end of the sheet
S sheet

We claim:

1. A knife folding machine, comprising:

a frame (1) having a support surface (4) to support a lower surface of a sheet (S);

a conveyor attached to the frame (1) to sequentially feed the sheet (S) to a fold position on the support surface (4);

a stopper (14) attached to the frame (1) and extending in a direction perpendicular to a feed path of the sheet (S), the stopper (14) positioning the sheet (S) at the fold position by a front end of the sheet (S) abutting the stopper (14);

a knife blade (5);

a pair of folding rollers (6*a*, 6*b*) opposed to the knife blade (5) at the fold position with the support surface (4) therebetween, the folding rollers (6*a*, 6*b*) being attached to the frame (1), the knife blade (5) and the folding rollers (6*a*, 6*b*) being disposed in parallel to each other and the feed path, the support surface (4) having an opening (3) through which the knife blade (5) passes;

a knife drive unit (7) for reciprocating the knife blade (5) in a direction perpendicular to the support surface (4) through the opening (3) between a first position and a second position, the first position being opposite to the folding rollers (6*a*, 6*b*) with the support surface (4) therebetween and spaced from the support surface (4), the second position being adjacent a gap between the folding rollers (6*a*, 6*b*);

a support arm (8) attached to the frame (1) to support the knife drive unit (7); and a control unit means (12) for controlling the knife drive unit (7); wherein a reciprocal movement of the knife blade (5) between the first and second positions effects a folding operation every time the sheet (S) is set at the fold position, wherein while the knife blade (5) moves from the first position to the second position, the sheet (S) on the support surface (4)

is folded in two by the knife blade (5) at a folded portion, an edge of the folded portion thereof being pushed out of the opening (3) and inserted into the gap between the folding rollers (6*a*, 6*b*) so that the sheet (S) can be folded by the folding rollers (6*a*, 6*b*);

wherein the conveyor comprises:

a drive roller (9) and an idle roller (10) attached to the frame (1) and parallel spaced from each other;

at least one conveyer belt (13) extending between the drive roller (9) and the idle roller (10) and circulating along the feed path; and a first servomotor (11) attached to the frame (1) to rotate the drive roller (9), a part of the support surface (4) being formed by a feed surface of the conveyer belt (13), the first servomotor (11) being controlled by the control unit means (12); wherein the knife folding machine further comprises:

a sensor (16) disposed in the middle way of the feed path to detect a passage of the sheet (S); wherein the control unit means (12) comprises:

means for decelerating the first servomotor (11) to a predetermined rotary speed during the period from the passage of the sheet (S) through the sensor (16) to its abutment against the stopper (14) so as to prevent the sheet (S) from rebounding from the stopper (14) when the sheet (S) abuts against the stopper (14);

means for maintaining the predetermined rotary speed of the first servomotor (11);

means for then starting both the folding operation of the knife blade (5) and an acceleration of the first servomotor (11) at the same time as the sheet (S) abuts against the stopper (14); and means for then accelerating the first servomotor (11) to a rotary speed before the deceleration during the period from the start of the folding operation to the start of the feed of the next sheet (S).

2. The knife folding machine according to claim 1, wherein the control unit means (12) comprises:

means for decelerating or accelerating the first servomotor (11) at a predetermined constant acceleration.

3. The knife folding machine according to claim 2, wherein the control unit means (12) comprises:

a first portion (17) for receiving input of a coordinate correction amount to correct a default start position of deceleration between the stopper (14) and the sensor (16) in a direction of the feed path; and a first storage device (18) for storing the coordinate correction amount inputted through the first portion (17); and means for starting the deceleration of the servomotor (11) when the control unit means (12) detects an arrival of a front end (P) of the sheet (S) at the start position of deceleration which was shifted depending on the coordinate correction amount based on an output value from an encoder installed in the first servomotor (11).

4. The knife folding machine according to claim 2, wherein the control unit means (12) comprises:

a first portion (17) for receiving input of a coordinate correction amount to correct a default start position of deceleration between the stopper (14) and the sensor (16) in a direction of the feed path;

a first storage device (18) for storing the coordinate correction amount inputted through the first portion (17);

a timer for measuring a time elapsed from the passage of the front end (P) of the sheet (S) through the sensor (16); and means for starting the deceleration of the servomotor (11) when the control unit means (12) detects an arrival of a front end (P) of the sheet (S) at the start position of deceleration which was shifted depending on the coordinate correction amount based on a measurement value of the timer.

5. The knife folding machine according to claim 4, wherein the knife drive unit (7) comprises:

a holder (19) attached to the support arm (8);

a rod (20) extending in a direction perpendicular to the support surface (4) and attached to the holder (19) to reciprocate in an axial direction thereof, the rod (20) being attached to the knife blade (5) at one end thereof;

a block (21) attached to a center portion of the rod (20);

a feed screw (22) extending in parallel to the rod (20) and attached to the holder (19) to rotate around an axis thereof, the block (21) having a through hole which has thread grooves corresponding to the feed screw (22), the feed screw (22) engaging with the through hole, the rod (20) being reciprocated by the feed screw (22) rotating;

a first pulley (23) attached to an upper or lower end of the feed screw (22);

a second servomotor (24) attached to the holder (19) and having a drive shaft (24*a*), the drive shaft (24*a*) extending in parallel to the feed screw (22);

a second pulley (25) attached to the drive shaft (24*a*) of the second servomotor (24); and a timing belt (26) extending between the first and second pulleys (23, 25), the second servomotor (24) being controlled by the control unit means (12).

6. The knife folding machine according to claim 5, wherein the control unit means (12) comprises:

a second portion (27) for receiving input of both data of a distance (d1) from the support surface (4) to the first position and data of a distance (d2) from the support surface (4) to the second position; and a second storage device (28) for storing the data of the distances (d1, d2) inputted through the second portion (27); and means for controlling the second servomotor (24) based on the data of the distances (d1, d2) stored in the second storage device (28).

7. The knife folding machine according to claim 6, wherein the control unit means (12) comprises:

a third portion (29) for receiving input of a time correction value to correct a default time from the passage of the front end (P) of the sheet (S) through the sensor (16) to the start of the folding operation of the knife blade (5); and a third storage device (30) for storing the time correction value inputted through the third portion (29); and wherein the folding operation is started when a time summed up in both the default time and the time correction value is elapsed after the passage of the front end (P) of the sheet (S) through the sensor (16).

* * * * *